United States Patent [19]

Bianchi

[11] 4,200,050

[45] Apr. 29, 1980

[54] THREAD CUTTING DEVICE FOR LOCKSTITCH SEWING MACHINES

[75] Inventor: Nereo Bianchi, Pavia, Italy

[73] Assignee: Necchi Societa per Azioni, Pavia, Italy

[21] Appl. No.: 939,879

[22] Filed: Sep. 5, 1978

[30] Foreign Application Priority Data

Sep. 27, 1977 [IT] Italy ..... 42911 A/77

[51] Int. Cl.[2] ..... D05B 65/00; D05B 53/00

[52] U.S. Cl. ..... 112/292; 112/253

[58] Field of Search ..... 112/292, 295, 294, 297, 112/298, 253

[56] References Cited

U.S. PATENT DOCUMENTS

| | | | |
|---|---|---|---|
| 3,211,117 | 10/1965 | Speichermann et al. | 112/292 |
| 3,470,835 | 10/1969 | Saganowich | 112/292 X |
| 3,503,355 | 3/1970 | Hagemeyer et al. | 112/292 |
| 3,602,170 | 8/1971 | Sakashita | 112/292 |
| 3,658,021 | 4/1972 | Hedegaard et al. | 112/292 |

FOREIGN PATENT DOCUMENTS

| | | | |
|---|---|---|---|
| 1119955 | 7/1968 | United Kingdom | 112/292 |

*Primary Examiner*—H. Hampton Hunter

*Attorney, Agent, or Firm*—Stevens, Davis, Miller & Mosher

[57] ABSTRACT

Thread cutting device for lockstitch sewing machines equipped with vertical axis looptaker and provided with a thread catching member displacing around an axis parallel to the looptaker axis along a path passing over the looptaker, wherein the thread catching member is formed by a plate ending with a pointed portion having a notching extending upwardly for the needle thread catching and a small foil bent at a right angle relative to the pointed portion, the small foil being so shaped as to be provided with a bobbin thread catching zone and a bobbin and needle thread cutting zone, the cutting zone being closer to the sewn fabric than the needle thread catching zone and than the notching for the needle thread catching.

1 Claim, 8 Drawing Figures

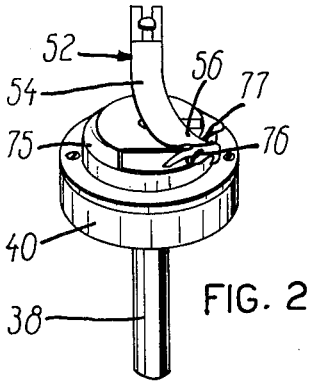
FIG. 2
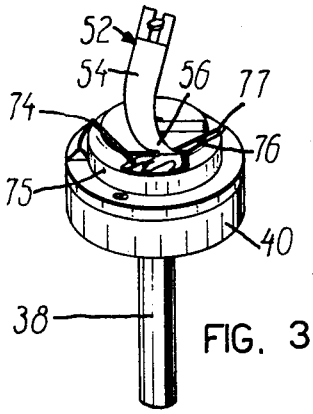
FIG. 3
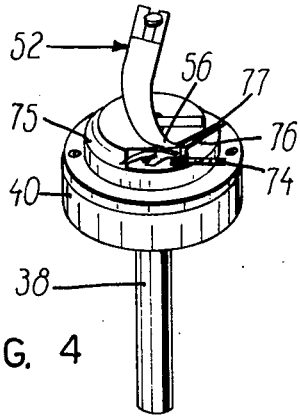
FIG. 4
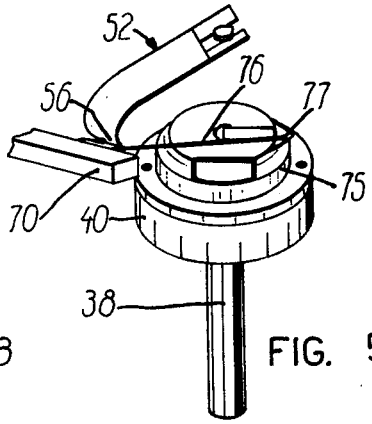
FIG. 5
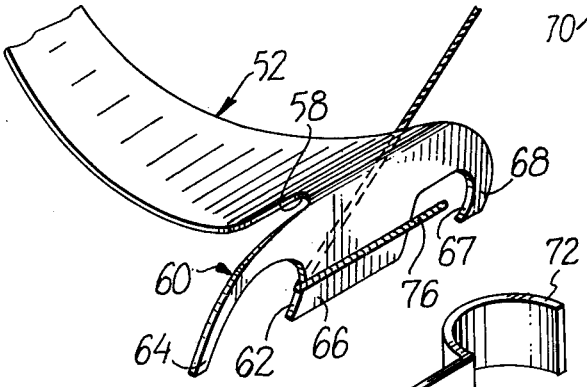
FIG. 8
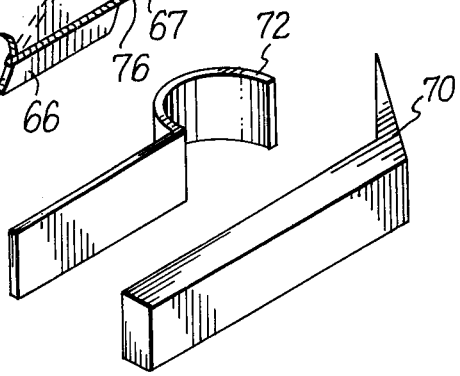

THREAD CUTTING DEVICE FOR LOCKSTITCH SEWING MACHINES

The present invention relates to a thread cutting device for lockstitch sewing machines. More particularly the device is applied to sewing machines provided with a vertical axis looptaker and comprises a thread catcher displacing around an axis parallel to the looptaker axis, along a path passing over the looptaker.

Thread cutting devices of the type known in the art, are provided, on the pointed portion of the catcher member with a sharp hook suitable to catch, during the displacement of the catcher, bobbin and needle threads taking them towards a counterblade to cut the threads at the end of a sewing cycle. The drawback of similar thread cutting devices, is that the bobbin thread portion projecting from the fabric and the thread portion of the bobbin have the same length, as do the needle thread portion projecting from the fabric and the one going to the needle. It is well known to the skilled in the art, that the needle and bobbin thread portions projecting from the fabric must be, for aesthetic reasons, as short as possible to avoid a subsequent manual cutting operation. To the contrary the thread portions leading to the needle and the bobbin must be sufficiently long to ensure locking at the beginning of the following sewing cycle.

Thread cutting devices are already known which will accomplish this feature. They are based on the fact that the catcher zone wherein the threads are severed does not coincide with the zone wherein threads are caught, but is displaced relative to the catching zone closer to the needle throat of the throat plate. The known devices have a complex structure and require quite severe modifications to their members.

An object of the present invention is to obtain the same feature mentioned above through slight modifications to the members generally used in such thread cutting devices.

The technical problem to be solved to attain said object is to give the catcher member such a shape as to cause caught threads to make a pre-determined path and to provide a cutting zone close to the fabric where the sewing operation is carried out.

The solution of the technical problem is characterized by the fact that the catcher member is formed by a plate ending with a pointed portion having a notching for catching the needle thread and a small foil, bent at a right angle relative to the pointed portion, the small foil being so shaped as to be provided with a bobbin thread catching zone and a bobbin and needle thread cutting zone. The cutting zone is closer to the sewn fabric than the bobbin thread catching zone and than the notching for the needle thread catching.

Further advantages will be better understood from the following detailed description taken together with the enclosed drawings wherein:

FIGS. 2, 3, 4 and 5 show four phases of the working cycle of the device of FIG. 1;

FIG. 8 is an expanded perspective view of the device of FIG. 7.

Figure 1:
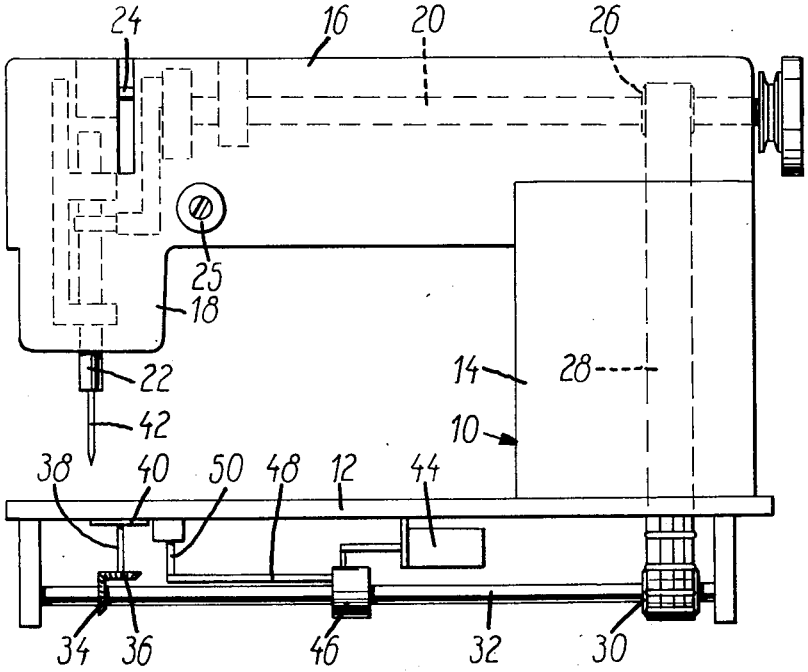
FIG. 1 shows a sewing machine in which the thread cutting device of the present invention is arranged.

FIG. 1 shows a sewing machine 10 of the industrial type provided with a bed 12, a standard 14, an arm 16 overhanging bed 12 and ending with head 18. Head 18 contains the usual members to turn the rotating motion of the main shaft 20 into reciprocating motion of the needle bar 22 and the take-up lever 24. Outside of the head 18 an upper thread tension adjusting device 25 is provided.

From pulley 26, fixed on the main shaft 20, rotating motion is passed through belt 28 and pulley 30, to lower shaft 32 which conveys it, through a crown wheel and pinion 34, 36 to vertical shaft 38 of looptaker 40 provided to cooperate with needle 42 in the formation of the stitch.

The thread cutting device, schematically shown in FIG. 1, is formed by an electromagnet 44 with the task of carrying out a coupling between cam 46 and a follower, not shown in FIG. 1, connected through rod 48 to shaft 50 on which thread catcher 52 is arranged.

Figure 7:
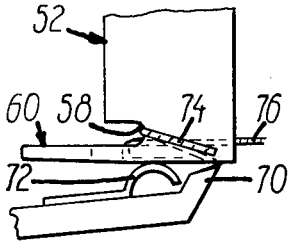
FIG. 7 is a plan view of the device of FIG. 6.

According to the object of the invention thread catcher 52, (FIGS. 7 and 8) provided to make over looptaker 40 horizontally alternated displacements, is formed by a plate 54.

Within bed 12 of sewing machine 10 there is provided a counterblade 70 and a thread retaining spring 72 suitable to cooperate respectively, with catcher 52 to sever needle thread 74 and lower thread 76 and clamping 76 once having executed the severing.

In FIGS. 2 to 5 numeral 75 indicates a bobbin case of looptaker 40 and 77, the exit bore from the bobbin case for the bobbin thread. When the operator controls the stop of the sewing machine and the sewing threads are cut, electromagnet 44 energizes thus allowing coupling between cam 46 and the cam follower connected to the catcher 52 through rod 48 and shaft 50. Such action is disclosed in U.S. Pat. No. 3,359,933.

Catcher 52 is urged to make a counterclockwise oscillation to take the position of FIG. 2. At this moment of the sewing cycle the needle 42 is about at the bottom dead center of its oscillation. Cam 46 causes thus catcher 52 to make a first displacement opposite the preceding one, that is in the clockwise direction, during which it catches the bobbin thread 76 by its catching zone 62 (FIG. 3).

Catcher 52 stops a moment in this position, owing to a cam portion having constant radius and in the meanwhile looptaker 40, by its point, seizes the loop of the needle thread guiding it around the bobbin case (FIG. 3).

When take-up lever 24 during its upward stroke, withdraws the needle thread wound up around bobbin case 75, the loop upper portion is caught by notching 58 of pointed portion 56 (FIG. 4).

At this point in the cycle upper thread tension adjusting device 25 releases its tension and catcher 52, urged by cam 46, makes a second displacement again in the clockwise direction (FIG. 5).

During this phase (FIGS. 4 and 6) needle thread 74 no more urged, passes behind foil 60 through notching 58 to the cutting zone 67. Bobbin thread 76 also is arranged by passing beside foil 60 in the cutting zone 67 near needle thread 74. This cutting zone 67, at the end of the stroke of catcher 52, comes into contact with counterblade 70 (FIG. 7), causing cutting of the two threads and catching of the bobbin thread 76 by means of thread retaining spring 72 fixed to counterblade 70 (FIG. 5).

Figure 6:
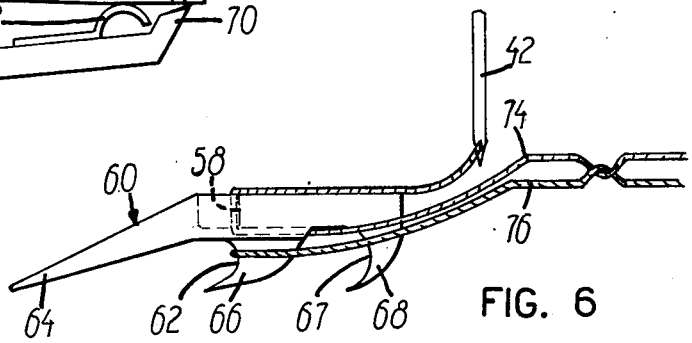
FIG. 6 shows a member of the thread cutting device of FIGS. 2–5.

FIG. 6 clearly shows, according to the present invention, that needle thread 74 and bobbin thread 76 leading to the fabric are severed in a zone nearer to the sewn fabric than the catching zone of said threads, while the portion of the needle thread leading to the needle is sufficiently long to ensure locking at the beginning of the following sewing cycle due to the added portion comprised from its catching zone (notching 58 to its cutting zone 67).

At the end of the cutting operation, the bobbin thread leading to the bobbin hole 77 is clamped between the surface of the tooth 66 and the retaining spring 72.

What is claimed is:

1. Thread cutting device for lockstitch sewing machines equipped with vertical axis looptaker and provided with a thread catching member displacing around an axis parallel to the looptaker axis along a path passing over the looptaker, a stationary counter-knife and thread clamping means cooperating with said thread catching member, cam means for imparting, in time relation, this displacement to the said thread catching member wherein said thread catching member is formed by a plate ending with a pointed portion having a notching for accommodating the needle thread loop, delimited by an edge of this plate and a vertical wall of a small foil at the free end thereof and at right angle to said plate portion, said small foil presenting a bobbin thread catching zone formed between a first and a second tooth and a bobbin and needle thread cutting zone between said second and a third tooth, the surface of this second tooth cooperating with said thread clamping means for clamping the bobbin thread at the end of the cutting operation.

* * * * *